US005154473A

United States Patent [19]

Joranco

[11] Patent Number: 5,154,473

[45] Date of Patent: Oct. 13, 1992

[54] CHAIR WITH SUN SCREEN AND WINDBREAKER PANEL

[76] Inventor: Charles T. Joranco, 791 Rolling Green Dr., Rio Vista, Calif. 94571

[21] Appl. No.: 526,926

[22] Filed: May 22, 1990

[51] Int. Cl.[5] ..... A47C 7/62

[52] U.S. Cl. ..... 297/184; 135/96

[58] Field of Search ..... 297/184, 229, 219, 396, 297/397, 218, 220, 228, 225; 135/96, 900, 901

[56] References Cited

U.S. PATENT DOCUMENTS

| | | | |
|---|---|---|---|
| 2,137,427 | 11/1938 | Thomson | 297/184 X |
| 2,635,916 | 4/1953 | Hammond . | |
| 2,691,178 | 10/1954 | Butterworth | 135/96 X |
| 2,990,008 | 6/1961 | Bien | 297/397 |
| 3,172,702 | 3/1965 | Rose | 297/230 X |
| 3,632,162 | 1/1972 | Trethaway | 297/397 X |
| 3,845,985 | 11/1974 | Behrond et al. | 297/184 |
| 3,865,429 | 2/1975 | Baricor | 297/184 |
| 3,879,086 | 4/1975 | Moceri | 297/184 |
| 4,030,748 | 6/1977 | Brock . | |
| 4,083,601 | 4/1978 | McBeth . | |
| 4,739,784 | 4/1988 | Fast . | |
| 4,790,340 | 10/1988 | Mahoney | 135/96 X |
| 4,877,288 | 10/1989 | Lee | 297/229 |
| 4,971,089 | 11/1990 | Braman | 297/184 X |

FOREIGN PATENT DOCUMENTS

| | | | |
|---|---|---|---|
| 2405391 | 9/1974 | Fed. Rep. of Germany | 297/184 |
| 2838941 | 3/1980 | Fed. Rep. of Germany | 297/184 |

*Primary Examiner*—Jose V. Chen

*Attorney, Agent, or Firm*—Townsend and Townsend

[57] ABSTRACT

A sun screen and windbreaker panel for a chair in which the panel is at the back of the chair. An overhead panel part can be used as a sun shade. The panel in one embodiment has a front surface provided with an inverted pocket which fits over the back of the chair. Bungee cords are used to couple the lower margins of the panel with the front of the chair. The panel has a resilient rod, in a bent condition near and along the outer periphery of the panel so that the panel will be stretched. The panel can be rectangular and can have a pair of resilient cross rods greater in length than the distance between the diagonal ends of the panel so that the rods, when in end pockets on the panel, will stretch the panel. In another embodiment, the panel is rolled up in the same manner as a window shade and pulled outwardly from a shaft to a predetermined length. Tie-down devices anchor the panel over a frame coupled to the back of a chair, and the shaft of the panel is rotatably mounted on the chair.

8 Claims, 3 Drawing Sheets

FIG. 1
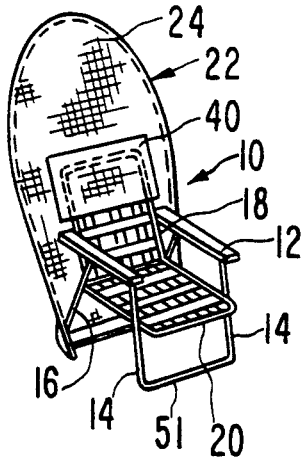
FIG. 4
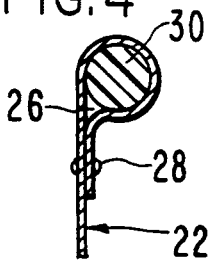
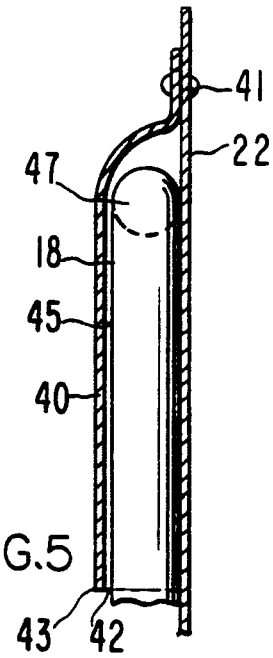
FIG. 5
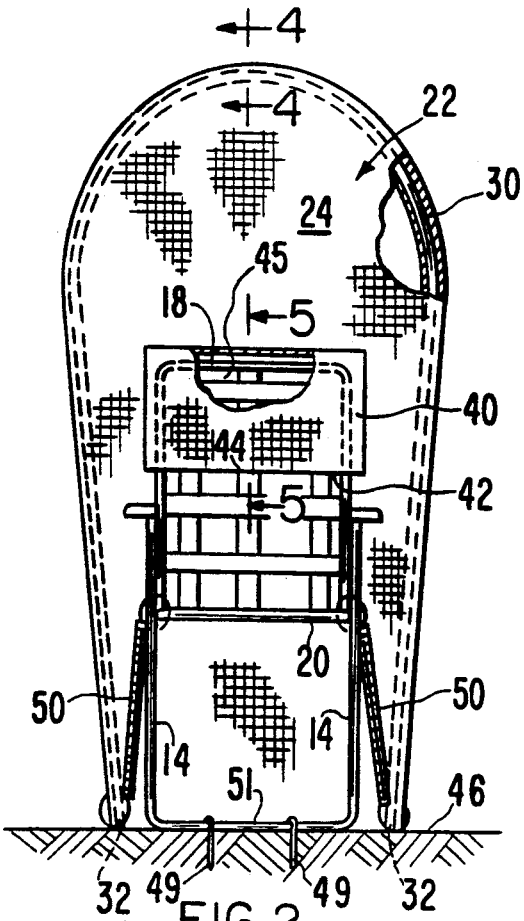
FIG. 2
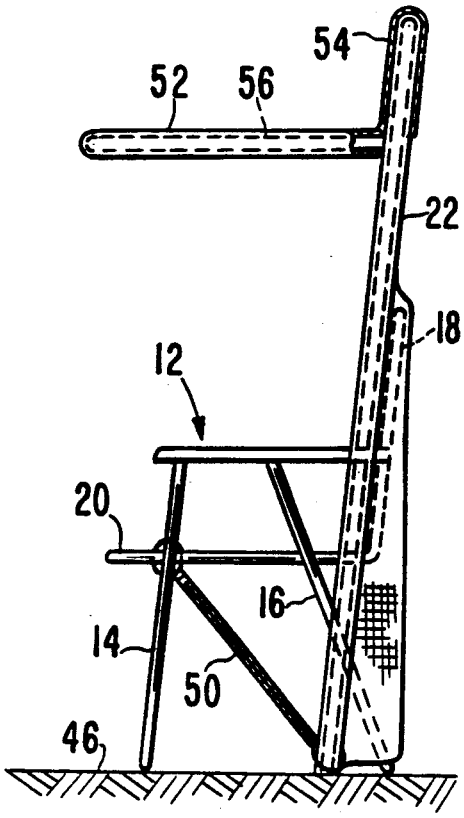
FIG. 3

FIG.11
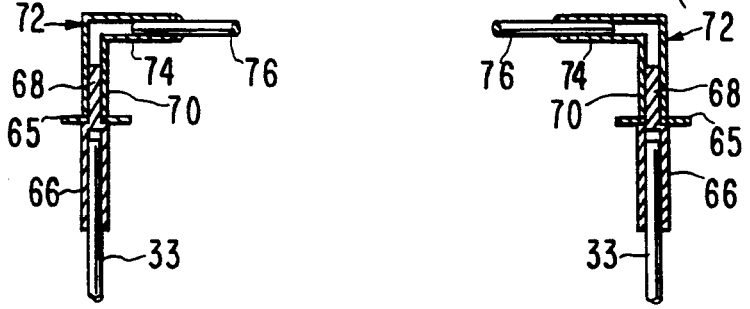
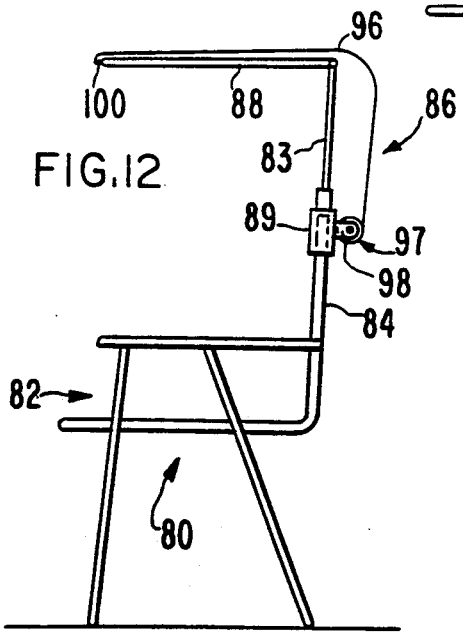
FIG.12
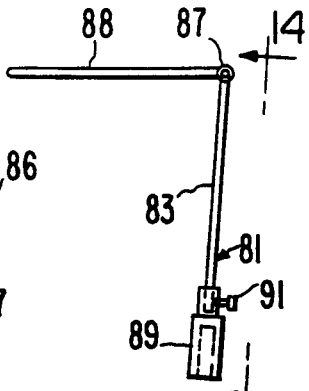
FIG.13
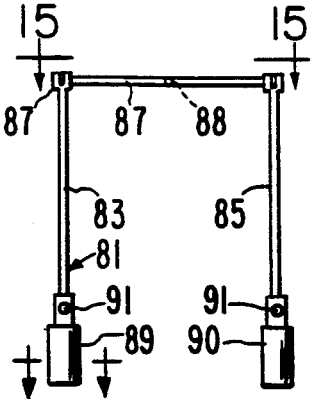
FIG.14
FIG.16
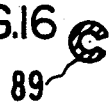
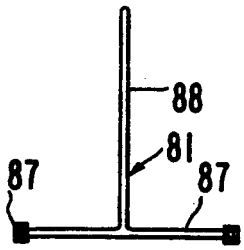
FIG.15
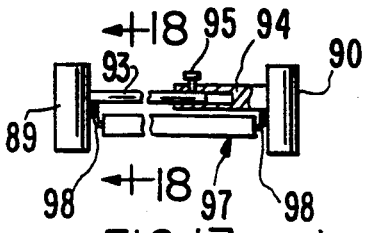
FIG.17
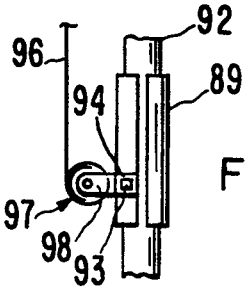
FIG.18

CHAIR WITH SUN SCREEN AND WINDBREAKER PANEL

BACKGROUND OF THE INVENTION

1. Field of the Invention

This invention relates to improvements in the use of chairs and, more particularly, to a chair having a sun screen and windbreaker panel removably coupled to the back of the chair.

2. Prior Art

Prior art references relating to this general subject matter are found in the following U.S. Pat. Nos.: 2,635,916; 4,030,748; 4,083,601 and 4,739,784.

In using lawn furniture, for instance, it is often desirable on a sunny and/or windy day to be free of the abrasive effects on the skin of the sun and the wind while still being able to sit in subdued sunlight. Lawn furniture generally is not constructed to provide for the stopping of the wind in the vicinity at which the lawn furniture is placed. While a house or fence may have some sun screening and windbreaking effect, these structures generally are far enough away from a person sitting in a lawn chair to be of little or no effect. Umbrellas, of course, have been used to screen the sun.

Because of the limitations described herein of conventional lawn chairs, a need exists for improvements in lawn furniture to screen the sun and/or break the wind at certain times during the day when wind speeds are high and when it is desirable to sit in the open air without being subjected to the harsh effects of the sun and the wind. The present invention satisfies this need.

SUMMARY OF THE INVENTION

The present invention provides a sun screen and windbreaker panel for a chair in which the panel in a preferred embodiment has an area greater than the area of the back of the chair so that substantially the entire body of the person sitting in the chair will be protected against the wind. An overhead panel part can be used as a sun screen.

The panel has a front surface provided with an inverted pocket which fits over the back of the chair when the panel is behind the chair. Bungee cords or other tie-down devices can be used to couple the lower margins of the panel with the front of the chair near the front legs thereof.

The panel can be of any suitable sheet material, such as a stretchable synthetic plastic. Nylon is suitable for this purpose.

The panel, in one embodiment, has means for holding a resilient rod, such as a fiberglass rod, in a bent condition near and along the outer periphery of the panel so that the panel will be stretched and rendered taut. Upon removal of the rod, the panel can be rolled into a compact form for storage. The rod itself can be a single rod or can be a series of interconnected, end-to-end resilient rods.

In a second embodiment of the panel, the panel is rectangular and has sheet-like segments provided at the four corners of the panel on the rear surface thereof. These segments provide diagonal pockets for receiving the respective ends of a pair of resilient cross rods. The rods are greater in length than the distance between the diagonal pockets so that the rods, when in the pockets, will stretch the panel and will render it substantially taut.

In a third embodiment, the panel is initially rolled up in the same manner as a window shade and pulled outwardly from a shaft to a predetermined length. Tie-down means anchors the panel over a frame coupled to the back of a chair, and the shaft of the panel is rotatably mounted on the chair and is removable therefrom.

The primary object of the present invention is to provide an improved chair and panel assembly in which the panel has means for attaching the panel to the back of the chair so that the panel will form a sun screen and/or a windbreaker for a person sitting in the chair.

Another object of the present invention is to provide an assembly of the type described, wherein the panel can be dismantled and rolled into a compact form for easy storage yet the panel can be placed in an operative condition with no special skills on the part of the user.

Other objects of this invention will become apparent as the following specification progresses, reference being had to the accompanying drawings for an illustration of several embodiments of the invention.

THE DRAWINGS

FIG. 1 is a perspective view of a lawn chair with a first embodiment the improved sun screen and windbreaker panel removably coupled thereto.

FIG. 2 is a front elevational view of the chair and panel, the panel being partly broken away and in section to illustrate details of construction;

FIG. 3 is a side elevational view of chair and panel, showing a sun shield attached to the upper part of the panel;

FIG. 4 is an enlarged, fragmentary cross-sectional view taken along line 4—4 of FIG. 2;

FIG. 5 is an enlarged, fragmentary cross-sectional view taken along line 5—5 of FIG. 2;

FIG. 11 is an enlarged, fragmentary front elevational view of the stretch rods, showing the way in which the rods have fittings to mount a flexible, resilient rod insertable in a passage in the outer periphery of the sun shade of FIGS. 8 and 10;

FIG. 12 is a side elevational view of another embodiment of the chair and panel assembly of the present invention, showing a window shade-like member releasably attached to the rear of the back of the chair;

FIG. 13 is an enlarged, side elevational view of the frame for the curtain-like member of FIG. 12 on a chair;

FIG. 14 is a rear elevational view of the frame of FIG. 13, looking in the direction of line 14—14 of FIG. 13;

FIG. 15 is a top plan view of the frame of FIG. 14, looking in the direction of line 15—15 of FIG. 14;

FIG. 16 is a cross sectional view taken along line 16—16 of FIG. 14;

FIG. 17 is a rear elevational view of the curtain assembly of the embodiment of FIG. 14; and FIG. 18 is an enlarged, fragmentary cross sectional view taken along 18—18 of FIG. 17.

DESCRIPTION OF THE PREFERRED EMBODIMENT

Figure 6:
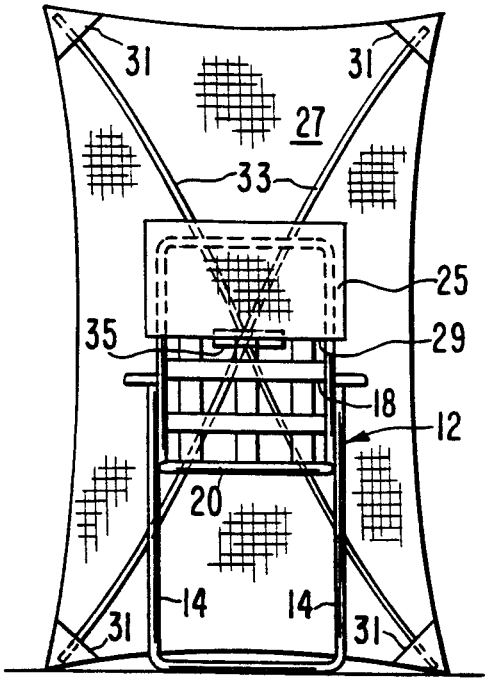
FIG. 6 is a view similar to FIG. 4 but showing another embodiment of the panel of the present invention.

The chair and panel assembly of the present invention, in one embodiment, is broadly denoted by the numeral 10 and includes a chair 12 having a pair of front legs 14 and a pair of rear legs 16. The chair further has a back 18 at the rear end of the seat 20. For purposes of illustration, the chair is shown as being a lawn chair; however, any suitable type of chair can be used to carry out the teachings of the present invention so long as the chair has a back, such as back 18.

A first embodiment of the panel of the present invention is shown in FIGS. 1-3 and is removably coupled to back 18 of chair 12. Panel 22 is provided for chair 12 to provide a sun screen and/or a windbreaker for a person sitting in the chair. The height of the panel is greater than the height of back 18 and the width of the panel is greater than the width of the back 18. Moreover, the panel extends substantially to the bottom ends of rear legs 16 of chair 12 so that a person sitting in the chair is adequately protected against the harsh effects of the wind blowing in the vicinity of the chair. Typically, the wind will be blowing normally to the plane of the panel, the plane of panel being typically substantially flat except possibly for some slight curvature throughout the main portion of the panel.

Panel 22 comprises a stretchable sheet of suitable windbreaking material, such as a synthetic plastic. Nylon is a suitable material for this purpose. Panel 22 has an outer peripheral passage 26 for retaining a resilient rod 30, as shown in FIG. 4. Passage 26 can be formed in any suitable manner such as by folding over the outer peripheral margin of sheet 24 and securing, such as by stitching 28, to the main body of the sheet. Other ways of retaining rod 30 can be provided, if desired.

Resilient rod 30, or a series of rods connected end-to-end, extends through passage 26 and is removable therefrom for storage purposes. For purposes of illustration, a single rod 30 will be described herein although it is to be understood that a single rod can be formed from a number of interconnected, end-to-end rods. The length of passage 26 is from one end 32 of rod 30 to the opposite end 34 of rod 30 as shown in FIG. 2 when the panel is coupled with the chair. The height of sheet 24 is greater than the height of the back of chair 12 and the width is greater than the width of the chair as shown in FIG. 2. The rod 30 stretches the material of sheet 24 so that the sheet forms an effective wall which, while possibly being slightly porous, breaks the wind flowing in the direction normal or substantially normal to the panel and thereby the panel adds to the comfort of the person sitting in the chair.

The panel 22 has a rectangular sheet 40 secured in any suitable manner to the front face of the panel. Sheet 40 may be secured, such as by stitching 4 (FIG. 5) along an inverted U-shaped line so that the bottom margin 43 of sheet 40 is unstitched and forms an opening 42 for receiving the upper part of back 18 of chair 12. Thus, sheet 40 and the stitching 41 securing it panel 22 forms an inverted, open end pocket 45 which easily and removably fits over the upper end of chair back 18 as shown in FIGS. 1-3. Thus, the panel is coupled with the chair.

The width of sheet 40 is substantially the same as or slightly greater than the width of chair back 18 so that the chair back 18 will fit tightly in the pocket 45 formed by sheet 40.

The height of the upper margin of pocket 45 is such as to have the upper cross bar 47 of back 18 fit close to but slightly below the stitching 41 at the upper margin of sheet 40. For chairs having high backs, sheet 40 may be slit along a line identified by the dashed line 44 (FIG. 1), and the back 18 can be inserted in the slit if the back is greater than an average height. In such a case, the lower end of the panel may be slightly elevated from the ground level 46 but this should not cause discomfort of the person sitting in the chair.

Two bungee cords 48 and 50 can be provided for the lower ends of rod 30 for connecting the rod ends to the junction between the seat 20 and the front legs 14 as shown in FIGS. 2 and 3. This feature anchors the lower ends of the panel to the chair as the midpoint of the panel is coupled by the pocket 45 to the back 18 of the chair.

In use, rod 30 is first forced into and through passage 26 to stretch the panel material and to form panel 22 as shown in FIGS. 1 and 2. Then the panel is placed on the back of the chair by inserting the back in the pocket 45 through the lower open end 42 of the pocket. Following this, the bungee cords 48 and 50 are put in place to couple the lower margins of rod 30 to the seat 20 at the junctions of legs 14. Tent stakes 49 can be driven into the ground to anchor the lower crossbars 51 of the chair to the ground to prevent tipping. The person using the chair can then sit in the chair and be protected against the wind and can move the chair frequently, if desired, when the direction of the wind changes.

An overhead sun shield 52 (FIG. 3) can be secured in any suitable manner, such as by an inverted U-shaped clamp 54 to the upper margin of panel 22. Thus, the sun shield can be rotated with respect to the panel, if desired, to get more favorable sun shielding effects.

Sun shield 52 is also a stretched panel of nylon or the like, the shield having an outer peripheral passage for receiving a rod 56 which is resilient and can bend to fit the shape of the passage of the sun shield 52. Other means other than clamp 54 can be used, such as a pair of spring clips, to secure the sun shield 52 to the upper part of panel 22.

To store panel 22, the panel is separated from the chair by removing bungee cords 48 and 50 and lifting the panel out of the pocket 45. Then, the resilient rod 30 is removed from passage 26 and the rod separated into segments, if a segmented rod is used, following which the panel will be flexible and can be rolled into a bundle capable of being easily stored in a small space. If a sun shield 52 is used, the sun shield can first be removed from the panel 22, the rod 56 can be removed from the outer peripheral passage of panel 52, and the panel and rod can then be rolled into a single bundle capable of being stored in a small space.

Figure 7:
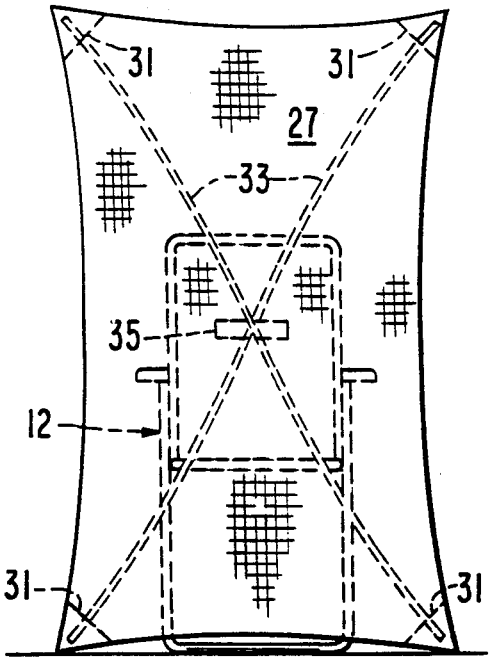
FIG. 7 is a rear elevational view of the panel of FIG. 6.
Figure 8:
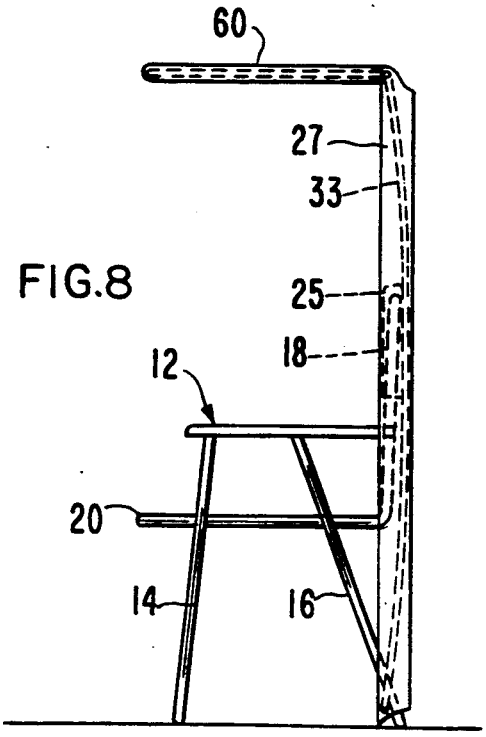
FIG. 8 is a view similar to FIG. 3 but showing the panels of FIGS. 6 and 7 on a chair.

Another, preferred embodiment of the sun screen and windbreaker panel is shown in FIGS. 6-8 and includes a panel 23 which is generally rectangular in configuration and has an inverted pocket formed by a sheet 25 stitched to the front face 27 of the panel 23. Sheet 25 has a lower unstitched margin 29 which forms the opening of the pocket for receiving the back 18 of chair 12.

The front side of panel 23 has triangular segments 31 at the corners of the panel, and the segments which have open ends for receiving the respective ends of a pair of resilient, stretch rods 33 which cross in the middle and are secured by a piece of tape 35 to the front side of panel 23.

Rods 33 are slightly longer than the distance between diagonal segments 31 so that, when the ends of the rods are put into the pockets formed by segments 31, and released, the panel 23 is stretched and made taut. The panel remains taut when back 18 is placed into the pocket formed by panel 23 and sheet 25. Bungee cords 37 can be used to couple the lower ends of rods 33 to seat 20 near the front legs 14 of chair 12.

Figure 10:
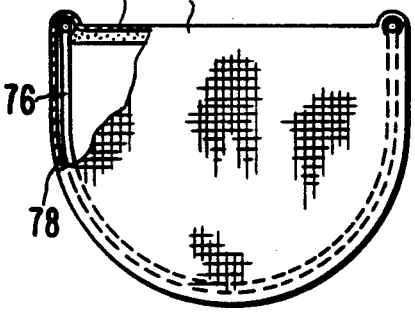
FIG. 10 is a top plan view of the sun shade at the upper end of the back panel of FIG. 8.

A sun shade or screen 60 (FIGS. 8 and 9) may be provided on panel 23 at the upper margin thereof, the sun shade being a sheet material of the same type as panel 23. The sheet 60 is stitched along a line 62 (FIG. 10) so that panel 60 can project forwardly as shown in FIG. 8 from panel 23 an overly the person sitting in the chair.

Figure 9:
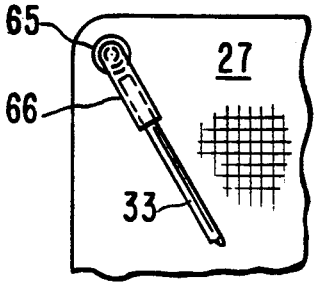
FIG. 9 is a fragmentary front elevational view of a modified embodiment of the panel of FIGS. 6–8, showing an upper grommet for receiving the modified end of the adjacent stretch rod.

An alternate way of connecting the stretch rods 33 to the corners of the panel 23 is shown in FIG. 9 and includes a grommet 65 for each corner, respectively, of the panel 23. Each cross rod 33 has a pair of ends, and for each end, respectively, there is an adapter 66 which is tubular at one end thereof for fitting over the adjacent end of the rod 33. Adapter 66 has a finger of smaller diameter than the tubular end of adapter 66, the finger being denoted by the numeral 68 and insertable through the adjacent grommet 65 and into a tubular segment 70 of an L-shaped member 72 having a second tubular segment 74. The corresponding end of the other stretch rod 33 has an adapter 66 with a finger 68 insertable through the adjacent grommet 65 and into the tubular segment 70 of an L-shaped member 72 having second tubular segment 74. These segments 74 are adapted to receive the ends of a flexible, resilient rod 76 which is threaded through an outer peripheral passage 78 of panel 60. Fingers 68 of adapter 66 are fitted in to the adjacent grommets 65 at the upper corners of panel 23. Thus, when panel 60 is mounted on the upper ends of rods 33 and is stitched to the upper margin of panel 23 and when rod 76 is taut, panel 60 will also be taut and project forwardly from panel 23 at the upper margin thereof as shown in FIG. 8. Thus, the taut panel 60 then presents a sun shade which is used in conjunction with sun screen and windbreaker panel 23.

Another embodiment of the chair and panel assembly of the present invention is broadly denoted by the numeral 80 and is shown in FIG. 12. Assembly 80 includes a chair 82 having a back 84 provided with a curtain-like assembly 86 thereon for providing a windbreaker panel and a sun screen part. Assembly 86 includes a frame 81 comprised of a pair of upright rods 83 and 85, a cross bar 87 and a horizontal, forwardly projecting rod 88 (FIGS. 13 and 14). The lower end of rods 83 and 85 are adjustably coupled to a pair of clamp-like elements 89 and 90 which are provided with set screws 91 for adjustably connecting elements 89 and 90 to the lower ends of rods 83 and 85, respectively. Elements 89 and 90 are adapted to be coupled to the sides of the back 84 of chair 82, the sides being denoted by the numeral 92 in FIG. 18. When elements 89 and 90 are coupled to the back of the chair, the frame will project upwardly from elements 89 and 90, and bar or rod 88 will overly a person sitting in the chair.

Elements 89 and 90 are coupled together as shown in FIG. 17 by a pair of relatively telescoped members 93 and 94 coupled to respective elements 89 and 90. A set screw 95 secures the members 93 and 94 together. The adjustment is made to accommodate chair back portions 84 of different widths.

A curtain-like sheet 96 is carried around by a roll 97 by brackets 98 coupled to respective members 93 and 94 as shown in FIGS. 17 and 18.

In use, with elements 89 and 90 connected to the chair back at the sides thereof due to the open sides of elements 89 and 90 (FIG. 16), and with frame 86 coupled with the elements 89 and 90, curtain-like sheet 96 is pulled upwardly from roll 97, over back bar 87, and then forwardly where the front end of the curtain-like sheet 96 can be coupled in any suitable manner to the front end of rod 8. A hook 100 can be used to this purpose. When so mounted, the curtain provides a windbreak and a sun screen as shown in FIG. 12.

A suitable cross section for each element 89 and 90 is shown in FIG. 16 wherein the element is made of plastic material and has an open side and open ends which frictionally receives and frictionally engage the adjacent portion of back 84 of chair 82.

I claim:

1. A windbreaker panel for a chair having a seat and a generally upright back comprising:

a panel having a pair of opposed surfaces including a front surface and adapted to be placed in a generally upright position behind the back of the chair, said panel having a number of corners, there being a pocket at each corner respectively, each pocket having an open end, a pair of resilient cross rods, the open end of each pocket being adapted to receive an end of a respective one of said rods, whereby the rods, when released, expand the panel to render it substantially taut; and means on the front surface of the panel for forming an inverted pocket for removably receiving the upper part of the back of the chair to couple the panel to the chair.

2. A panel as set forth in claim 1, wherein said corner pockets are triangular, said panel being generally rectangular and having a pair of upper corner pockets and a pair of lower corner pockets, the rods forming an X configuration when the ends of the rods are received in respective corner pockets.

3. A panel as set forth in claim 2, wherein the length of each rod is greater than the distance between the respective pockets for the ends of the rod.

4. In combination:

a chair having a seat and a generally upright back;

a windbreaker panel having a pair of opposed surfaces including a front surface and adapted to be placed in a generally upright position behind the back of the chair, said panel having a number of corners, there being a pocket at each corner respectively, each pocket having an open end, a pair of resilient cross rods, the open end of each pocket being adapted to receive one end of a respective one of the rods, whereby the rods, when released, expand the sheet to render it substantially taut; and means on the front surface of the panel for forming an inserted pocket for removably receiving the upper part of the back of the chair to couple the panel to the chair.

5. A panel as set forth in claim 4, wherein said corner pockets are triangular, said panel being generally rectangular and having a pair of upper corner pockets and a pair of lower corner pockets, the rods forming an X configuration when the ends of the rods are received in respective corner pockets.

6. A panel as set forth in claim 4, wherein the length of each rod is greater than the distance between the respective pockets for the ends of the rod.

7. A windbreaker panel for a chair having a seat and a generally upright back comprising:

a panel having a front surface and being of a configuration sufficient to permit the panel to be placed in a generally upright position behind and adjacent to the chair; and means on the front surface of the panel for forming an inverted pocket for removably receiving the upper part of the back of the chair to couple the panel to the chair when the panel is in said upright position, said pocket means including a sheet having a top portion, a bottom portion and a pair of side portions, said portions being at the outer periphery of the sheet, said top and side portions being secured to the panel, the bottom portion being movable outwardly of the panel.

8. A panel as set forth in claim 7, wherein the sheet is stitched at the top and side positions thereof to the panel.

* * * * *